US011644266B2

(12) United States Patent
Engelbreit

(10) Patent No.: US 11,644,266 B2
(45) Date of Patent: May 9, 2023

(54) SILENCER FOR MOUNTING ON A GUN BARREL

(71) Applicant: EP Arms GmbH, Roethenbach an der Pegnitz (DE)

(72) Inventor: Philipp Engelbreit, Lauf an der Pegnitz (DE)

(73) Assignee: EP Arms GmbH, Roethenbach an der Pegnitz (DE)

( * ) Notice: Subject to any disclaimer, the term of this patent is extended or adjusted under 35 U.S.C. 154(b) by 0 days.

(21) Appl. No.: 17/540,627

(22) Filed: Dec. 2, 2021

(65) Prior Publication Data

US 2022/0170712 A1 Jun. 2, 2022

(30) Foreign Application Priority Data

Dec. 2, 2020 (DE) ..... 10 2020 132 017.5

(51) Int. Cl.
*F41A 21/32* (2006.01)
*F41A 21/30* (2006.01)

(52) U.S. Cl.
CPC ..... *F41A 21/32* (2013.01); *F41A 21/30* (2013.01)

(58) Field of Classification Search
CPC ..... F41A 21/28; F41A 21/325; F41A 21/32; F41A 21/30
See application file for complete search history.

(56) References Cited

U.S. PATENT DOCUMENTS

| | | | | |
|---|---|---|---|---|
| 1,435,084 | A * | 11/1922 | Schneider | F41A 21/325 89/14.3 |
| 4,479,418 | A | 10/1984 | Beretta | |
| 4,939,977 | A * | 7/1990 | Stroup | F41A 21/30 89/14.4 |
| 5,136,923 | A * | 8/1992 | Walsh, Jr. | F41A 21/30 89/14.4 |
| 6,385,891 | B1 * | 5/2002 | Rabatin | F41A 21/325 42/79 |
| 8,291,805 | B1 * | 10/2012 | Quilligan | F41A 21/325 285/305 |
| 9,658,019 | B2 | 5/2017 | Smith | |
| 9,891,017 | B1 * | 2/2018 | Lee | F41A 21/325 |
| 10,066,890 | B1 * | 9/2018 | Lee | F41A 21/44 |
| 10,082,354 | B1 | 9/2018 | Lee | |
| 10,969,188 | B1 | 4/2021 | Cottingham | |
| 11,268,779 | B1 * | 3/2022 | Lee | F41A 21/325 |
| 11,397,065 | B2 * | 7/2022 | Vanhatalo | F41A 21/325 |

(Continued)

FOREIGN PATENT DOCUMENTS

| | | |
|---|---|---|
| DE | 102016000437 A1 | 7/2017 |
| DE | 202016006589 U1 | 1/2018 |

(Continued)

*Primary Examiner* — Derrick R Morgan
(74) *Attorney, Agent, or Firm* — Laurence A. Greenberg; Werner H. Stemer; Ralph E. Locher

(57) ABSTRACT

A silencer for mounting on a gun barrel has a silencer housing for at least partially completely enclosing the gun barrel. A jacket pipe is integrated in the silencer housing for encasing the gun barrel. A muzzle brake is formed to hold the jacket pipe in a centered manner in the silencer housing. The silencer also includes at least one device for deflecting and/or cooling a gas that is produced when a shot is fired. A clamping device is provided for form-fitting and/or force-fitting fixing to the gun barrel.

11 Claims, 1 Drawing Sheet

(56) References Cited

U.S. PATENT DOCUMENTS

| | | | | |
|---|---|---|---|---|
| 2006/0060076 | A1* | 3/2006 | Dueck | F41A 21/325 89/14.4 |
| 2008/0098880 | A1 | 5/2008 | Brugger | |
| 2009/0050403 | A1* | 2/2009 | Brittingham | F41A 21/325 181/223 |
| 2009/0193963 | A1* | 8/2009 | Poulsen | F41A 21/30 89/14.4 |
| 2016/0097609 | A1* | 4/2016 | Penchuk | F41A 21/325 42/76.01 |
| 2016/0161203 | A1* | 6/2016 | Wilson | B23K 35/325 89/14.3 |
| 2018/0238653 | A1* | 8/2018 | Kunsky | F41A 21/30 |
| 2019/0033030 | A1 | 1/2019 | Belykov et al. | |
| 2019/0154386 | A1* | 5/2019 | Lee | F41A 21/325 |
| 2019/0195589 | A1* | 6/2019 | Lee | F41A 21/30 |
| 2021/0102774 | A1* | 4/2021 | Vanhatalo | F41A 21/325 |
| 2021/0381794 | A1* | 12/2021 | Lawson | F41A 21/30 |
| 2022/0026169 | A1* | 1/2022 | Hipp | F41A 21/325 |
| 2022/0099401 | A1* | 3/2022 | Langenbeck | F41A 21/482 |

FOREIGN PATENT DOCUMENTS

| | | | |
|---|---|---|---|
| DE | 202017101110 | U1 | 5/2018 |
| DE | 102019000223 | A1 | 7/2020 |
| EP | 3208567 | A1 | 8/2017 |

* cited by examiner

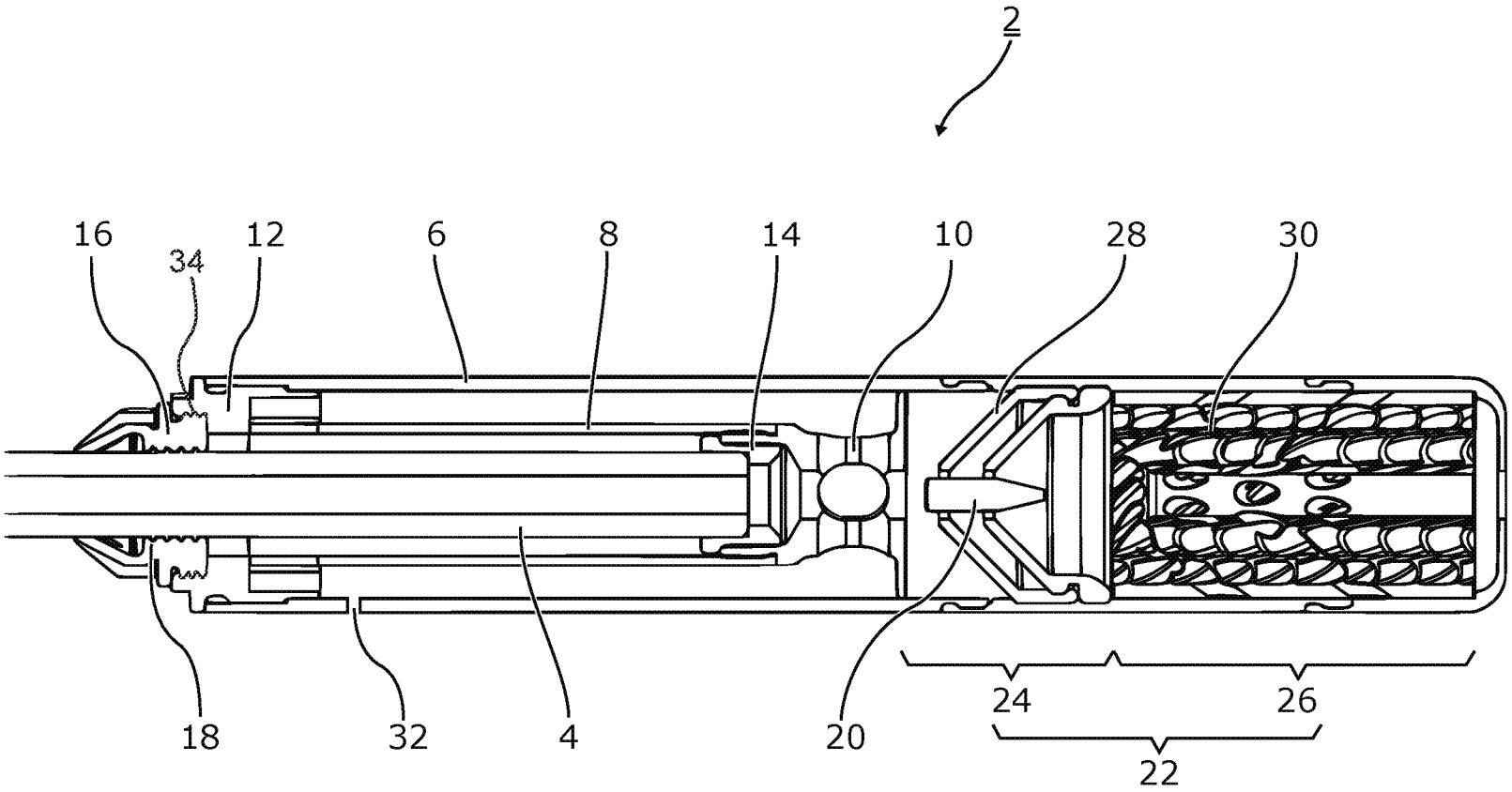
2
30
28
10
14
8
6
12
34
16
26
22
24
20
4
32
18

SILENCER FOR MOUNTING ON A GUN BARREL

CROSS-REFERENCE TO RELATED APPLICATION

This application claims the priority, under 35 U.S.C. § 119, of German Patent Application DE 10 2020 132 017.5, filed Dec. 2, 2020; the prior application is herewith incorporated by reference in its entirety.

FIELD AND BACKGROUND OF THE INVENTION

The invention relates to a silencer for mounting on a gun barrel. The device has a silencer housing for, at least in part, completely enclosing the gun barrel.

A silencer, also referred to as a muzzle signature reducer, is a device located at the muzzle of a gun barrel to reduce sound emissions and muzzle flash. Furthermore, silencers can also reduce recoil upon firing, which, together with the mass of the silencer, reduces the lifting impact of the gun. Furthermore, the accuracy of long guns is increased, as silencers have a positive physical effect on the (propulsion/combustion) gases trailing the projectile. Additionally, a silencer changes the sound of the muzzle blast.

Silencers reduce the volume of the muzzle blast and thus reduce the risk of hearing damage for hunters, beaters and dogs, for example. Unlike hearing protectors, silencers do not restrict three-dimensional hearing.

Such silencers are often designed as screw-on barrel attachments. In this context, the silencers have an internal thread, which can be screwed onto a corresponding external thread of a gun barrel (muzzle thread). In order to ensure the most tilt-free guidance and fastening possible, these threads are often formed with a fine thread. If, however, dirt or other debris attaches in this fine thread during a hunt, the fastening of the silencer is made more difficult or even made impossible.

SUMMARY OF THE INVENTION

The invention is based on the task of specifying a particularly suitable silencer for mounting on a gun barrel. In particular, a simple and effort-reduced assembly is to be made possible, even on gun barrels without a muzzle thread.

With the above and other objects in view there is provided, in accordance with the invention, a silencer for mounting on a gun barrel, the silencer comprising:

a silencer housing for completely enclosing the gun barrel, at least in part, when the silencer is mounted on the gun barrel;

a jacket pipe integrated into said silencer housing for enclosing the gun barrel;

a muzzle brake configured to hold said jacket pipe centered in said silencer housing;

at least one gas deflector configured for deflecting and/or cooling a gas produced when a shot is fired through the gun barrel; and a clamping device configured to fix the silencer with a form-fit and/or with a force-fit to the gun barrel.

In other words, the silencer according to the invention is provided for mounting on a gun barrel and it is suitable and configured for this purpose. The silencer is preferably designed as a barrel attachment, which can be mounted on a barrel or a muzzle of a gun, in particular a hand-held gun, preferably a hunting rifle.

The silencer has a silencer housing, which, in the assembled state, completely encloses the gun barrel, at least in sections. The silencer housing has an integrated jacket pipe, which preferably encloses the gun barrel in the assembled state. A muzzle brake is received in the silencer housing, which holds the jacket pipe in a centered manner in the silencer housing. In this case, the muzzle brake is provided and arranged for utilizing the energy of the combustion gases (propulsion gases) produced during a firing operation in order to reduce the recoil of the gun. The silencer further has a device for deflecting and/or cooling the gases produced during firing, whereby a reduction of the muzzle blast and muzzle flash is realized.

According to the invention, the silencer has a clamping device for form-fitting and/or force-fitting fixing of the gun barrel. In other words, a non-destructive clamping attachment of the silencer to the gun barrel is provided, i.e., the gun barrel is clamped by the clamping device. This makes it possible to mount the silencer also on a gun barrel without a muzzle thread. Thus, a particularly suitable silencer is realized.

The conjunction "and/or" here and in the following is to be understood in such a way that the characteristics linked by means of this conjunction can be formed both together or as alternatives to each another.

The terms "form fit" or a "form-fitting connection" (positive/interlocking connection) between at least two interconnected parts here and in the following is understood in particular to mean that the cohesion of the interconnected parts takes place at least in one direction by a direct interlocking of contours of the parts themselves or by an indirect interlocking via an additional connecting part. The "blocking" of a mutual movement in this direction thus takes place due to the shape.

The terms "force fit" or "force-fitting connection" (non-positive/friction fit or frictional connection) between at least two connected parts here and in the following is understood to mean in particular that the connected parts are prevented from sliding against each other due to a frictional force acting between them. If a "connecting force" causing this frictional force is missing (this means the force that presses the parts against each other, for example a screw force or the weight force itself), the force-fitting connection cannot be maintained and can therefore be released.

The silencer can preferably be completely disassembled manually and can be assembled by a user without any risk.

In a preferred embodiment, the clamping device is designed as a collet chuck. The collet chuck has, for example, an externally conical, radially slotted sleeve with a central bore as a receptacle or feed-through opening for the gun barrel. The sleeve or respectively the bore are adapted to the respective barrel diameter of the gun barrel. The collet chuck is clamped onto the gun barrel by means of a key or lever, for example. This ensures a particularly stable and reliable fastening of the silencer. In particular, a reduced effort and always centering clamping of the gun barrel is realized.

In an appropriate embodiment, the clamping device is arranged on an end face of the silencer housing. In other words, the clamping device is arranged on a side of the silencer housing opposite the outlet opening. In this case, the end face is designed, for example, as a removable housing cover.

In one possible embodiment, the silencer is designed, for example, as an integral silencer, wherein the silencer housing is not merely placed on the muzzle of the barrel but extends essentially completely over the gun barrel in its longitudinal direction and encloses it at least in sections like a jacket. This optimizes a damping performance of the silencer. Due to the frontal arrangement of the clamping device or collet chuck, a center of gravity of the silencer is shifted towards the rear, i.e., towards the gun and away from the muzzle of the gun barrel. Furthermore, the silencer thus has a particularly compact design in front of the barrel muzzle, which significantly improves the maneuverability and balance of the gun that is equipped with it.

In an expedient embodiment, the end face of the silencer housing is provided with an internal thread, into which an external thread of the clamping device is screwed or can be screwed. In other words, the clamping device or the collet chucks are screwed into the end face or the housing cover. Thereby, a simple and non-destructively detachable fastening of the clamping device to the silencer housing is realized. On the one hand, this enables simple assembly and disassembly of the silencer, for example for maintenance purposes. On the other hand, it is thus possible to exchange or change the clamping device or respectively the collet chuck, so that the silencer can be adapted to a particular gun barrel in a particularly variable and flexible manner by changing the clamping device.

In an advantageous further embodiment, the clamping device has at least one seal on an inner circumference surrounding or enclosing the gun barrel. In the assembled state, the clamping device—and thus the silencer—is sealed, in particular gas-tight, with respect to the outer circumference of the gun barrel by means of the seal. On the one hand, the seal absorbs the forces of the gas pressure of the combustion gases and, on the other hand, the clamping or chucking action of the clamping device or respectively of the collet chuck. The seal also increases the frictional resistance and thus the force-fitting holding force on the gun barrel.

Furthermore, the at least one seal enables the jacket pipe to be installed inside the silencer housing in a non-fixed manner, whereby a larger expansion chamber can be realized. This further improves the damping performance of the silencer.

An additional or further aspect of the invention provides a centering sleeve for centering the gun barrel, which is arranged on a front side of the barrel facing the muzzle brake. The silencer is thus centered relative to the barrel bore axis of the gun barrel via the centering sleeve. The gun barrel is thus held by the centering sleeve and the clamping device at two points. As a result, a reliable and safe holding and alignment of the silencer on a threadless gun barrel is realized.

When used on a gun barrel provided with a muzzle thread, it is possible, for example, to replace or exchange the centering sleeve with a threaded insert or a threaded sleeve in order to screw the silencer onto the gun barrel or respectively onto the muzzle thread. In the case of such a screw fastening, it is conceivable, for example, that a plastic insert is introduced on the end face or respectively the housing cover of the silencer housing, which prevents scratching of the gun barrel when it is fitted.

In one conceivable embodiment, the muzzle brake is screwed to the jacket pipe. In this way, a reliable fastening and holding of the jacket pipe in the silencer housing is realized. For example, the muzzle brake is externally screwed to the jacket pipe. For this purpose, the jacket pipe has an internal thread, and the muzzle brake has an external thread.

In an expedient embodiment, the device has an (baffle wall) chamber with a number of baffle walls and/or a (gas rotation) chamber with a gas rotation insert. Preferably, the device has both a baffle wall chamber and a gas rotation chamber, which are arranged downstream of each other. This enables a reliable reduction of sound emissions and of the muzzle flash.

The baffle walls are designed, for example, as reflective surfaces for the combustion gases. In this way, the propulsive gases of the projectile emerging from the muzzle are slowed down and cooled, which leads to a reduction of the muzzle blast and muzzle flash. The baffle walls are each designed, for example, as a conical shell of a cone, and have, for example, an opening angle of about 45°.

The gas rotation insert has a significant influence on the attenuation performance of the silencer. Due to the (gas) rotation insert, the gases are cooled very quickly, and the muzzle blast is swirled. The rotating insert preferably has a shape or geometry that realizes a particularly high damping performance in a compact design.

In a particularly preferred embodiment, the gas rotation insert is produced as an exchangeable 3D printed part. This means that the gas rotation insert is manufactured in a three-dimensional printing process, which enables a particularly effective and suitable shape and geometry with respect to the damping performance. This makes it possible to manufacture the silencer in substantially shorter designs, which provides a significant advantage for the handling of a gun equipped therewith.

Due to the interchangeability or replaceability of the gas rotation insert, it is furthermore possible to flexibly adapt the silencer to a respective caliber of the gun. For example, when changing the caliber, only the gas rotation insert needs to be replaced.

In a suitable further embodiment, an intermediate space is formed between the silencer housing and the jacket pipe, forming an expansion chamber, wherein the silencer housing has at least one vent hole for the intermediate space. The vent hole can in this case also be part of the device, for example. Through the vent hole, cold air can escape from the expansion chamber, so that the hot (combustion/propulsion) gases can spread out and be cooled more quickly. This further improves the damping performance of the silencer.

Furthermore, this has the additional effect that the silencer does not heat up so quickly. This reduces flickering visible in a target optics (scope) due to rising heat. In particular, such flickering only occurs after several shots fired in quick succession.

Furthermore, the vent hole allows moisture to escape from the jacket pipe. By the term "moisture" here and in the following it is meant in particular the presence of water, in particular in the form of water vapor from a humidity of an air enclosed in the jacket pipe. This means that an unbound water content may be present within the jacket pipe, which may chemically react with powder residues, for example, and lead to damage or corrosion. The vent hole ensures that the moisture can escape from the jacket pipe, which improves the service life of the jacket pipe and thus of the silencer.

Other features which are considered as characteristic for the invention are set forth in the appended claims.

Although the invention is illustrated and described herein as embodied in silencer for mounting on a gun barrel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE FIGURE

The sole FIGURE of the drawing is a longitudinal section through a silencer mounted on a gun barrel.

DETAILED DESCRIPTION OF THE INVENTION

Referring now to the FIGURE of the drawing in detail, there is shown a perspective sectional view of a silencer 2, which is mounted on the muzzle side of a gun barrel 4 of a gun. The gun, by way of example, is a hunting rifle. In this exemplary embodiment, the gun barrel 4 does not have a muzzle thread. In other words, the gun barrel 4 is formed without a thread.

The silencer 2 is designed in particular as an integral silencer and has a cylindrical or tubular silencer housing 6 forming an outer jacket pipe, which completely encloses the gun barrel 4 in sections. The silencer housing 6 receives an (inner) jacket pipe 8, which coaxially encloses the gun barrel 4. On the one hand, the jacket pipe 8 is held in a centered manner in the silencer housing 6 by means of a muzzle brake 10. On the other hand, the jacket pipe 8 is seated in a receptacle of an annular housing cover 12, which closes the silencer housing 6 at one end face.

The muzzle brake 10 engages at least in sections in the jacket pipe 8, wherein a centering sleeve 14 is arranged in the engaging region of the muzzle brake 10, by means of which the gun barrel 4 is center-aligned on the muzzle side in the jacket pipe 8 or respectively in the silencer housing 6. In this case, the muzzle brake 10 is provided in the engaging region with an external thread, which is screwed into a corresponding internal thread of the jacket pipe 8.

The housing cover 12 has a threaded bore on the outside of the housing, into which a clamping device 16, which is designed as a collet chuck, is screwed. For this purpose, the clamping device 16 has a fastening section provided with an external thread 34, which is screwed into the internal thread of the threaded hole. In the assembled state, the clamping device 16 fixes the silencer 2 in a form-fitting manner (i.e., positive fit) and/or force-fitting manner (i.e., friction fit) to the gun barrel 4.

The clamping device 16 has four axially distributed seals 18, which are arranged as radial ring seals on one of the clamping devices 16 surrounding or enclosing the gun barrel 4. In the assembled state, the clamping device 16—and thus the silencer 2—is sealed, in particular gas-tight, with respect to the outer circumference of the gun barrel 4 by means of the seals 18. On the one hand, the seals 18 absorb the forces of the gas pressure of the combustion gases and, on the other hand, the clamping or chucking action of the clamping device 16 or respectively of the collet chuck. The seals 18 further increase the frictional resistance and thus the force-fitting holding force on the gun barrel 4.

The terms "axial" and "axial direction" here and in the following are understood to mean in particular a direction parallel (coaxial) to the gun barrel 4, i.e., perpendicular to the end faces of the silencer 2. Correspondingly, the terms "radial" and "radial direction" here and in the following are understood in particular as a direction oriented perpendicularly (transversely) to the longitudinal axis of the gun barrel 4 along a radius of the gun barrel 4 or respectively of the silencer 2. The terms "tangential" and "tangential direction" here and in the following are understood to mean in particular a direction along the circumference of the silencer 2 or the gun barrel 4 (circumferential direction, azimuthal direction), i.e., a direction perpendicular or orthogonal to the axial direction and to the radial direction.

The FIGURE further shows a projectile 20 discharged from the gun barrel 4, which is shown in the region of a device 22 for deflecting and/or cooling a (propulsion/combustion) gas produced during a firing operation. In this case, the device 22, which is referred to as a gas deflector 22, has a baffle chamber 24 and a gas rotation chamber 26, which are connected axially in succession to the muzzle brake 10.

The baffle chamber 24 has, for example, two baffle walls 28 arranged one behind the other. The baffle walls 28 are each configured, for example, as a conical jacket of a cone, and have, for example, an opening angle of about 45°.

A substantially hollow cylindrical gas rotation insert 30 is received in the gas rotation chamber 26.

The gas rotation insert 30 preferably has a shape or geometry that realizes a particularly high damping performance in as compact an installation space as possible. The gas rotation insert 30 is in particular manufactured as an exchangeable 3D printed part.

Between the silencer housing 6 and the jacket pipe 8, an intermediate space (annular space), which is not described in more detail, is formed as an expansion chamber. In this case, the silencer housing 6 has at least one vent hole 32, which passes approximately radially through the silencer housing 6 and thus couples the expansion chamber or respectively the intermediate space to the environment. Through the vent hole 32, a cold air can escape from the expansion chamber, so that the hot (combustion/propulsion) gases can spread faster and be cooled down.

The silencer 2 can preferably be completely disassembled manually and can be assembled by a user without danger.

The invention is not limited to the embodiments described above. Rather, other variants of the invention may also be derived therefrom by the expert without digressing from the objects of the invention. It will furthermore be understood that all individual features described in connection with the exemplary embodiment can also be combined with each other in other ways without leaving the object of the invention.

The following is a summary list of reference numerals and the corresponding structure used in the above description of the invention:

2 silencer
4 gun barrel
6 silencer housing
8 jacket pipe
10 muzzle brake
12 housing cover
14 centering sleeve
16 clamping device
18 seal
20 projectile
22 device, gas deflector
24 baffle chamber
26 gas rotation chamber
28 baffle wall
30 gas rotation insert
32 vent hole
34 internal thread of 12, external thread of 16

The invention claimed is:

1. A silencer for mounting on a gun barrel, the silencer comprising:

a silencer housing for at least partially completely enclosing the gun barrel when the silencer is mounted on the gun barrel;

a jacket pipe integrated into said silencer housing for enclosing the gun barrel;

a muzzle brake configured to hold said jacket pipe centered in said silencer housing;

at least one gas deflector configured for deflecting and/or cooling a gas produced when a shot is fired through the gun barrel; and a collet chuck configured to fix the silencer with a form-fit and/or with a force-fit to the gun barrel, said collet chuck being formed with at least one seal, disposed on an inner circumference surrounding the gun barrel, for absorbing forces of a gas pressure produced when the shot is fired.

2. The silencer according to claim 1, wherein said collet chuck is disposed on an end face of said silencer housing.

3. The silencer according to claim 2, wherein the end face of said silencer housing is formed with an internal thread and the clamping device is formed with an external thread configured to mesh with said internal thread.

4. The silencer according to claim 1, which comprises a centering sleeve for centering the gun barrel disposed on an end face of said jacket pipe facing the muzzle brake.

5. The silencer according to claim 1, wherein said muzzle brake is screwed to said jacket pipe.

6. The silencer according to claim 1, wherein said at least one gas deflector is formed with a chamber having a plurality of baffle walls and/or a chamber with a gas rotation insert.

7. The silencer according to claim 6, wherein said gas rotation insert is a replaceable 3D printed part.

8. The silencer according to claim 1, wherein said silencer housing and said jacket pipe are disposed to form an intermediate space therebetween and wherein said silencer housing is formed with at least one vent hole for venting said intermediate space.

9. A silencer for mounting on a gun barrel, the silencer comprising:

a silencer housing for at least partially completely enclosing the gun barrel when the silencer is mounted on the gun barrel;

a jacket pipe integrated into said silencer housing for enclosing the gun barrel;

a muzzle brake configured to hold said jacket pipe centered in said silencer housing;

at least one gas deflector configured for deflecting and/or cooling a gas produced when a shot is fired through the gun barrel;

a clamping device configured to fix the silencer with a form-fit and/or with a force-fit to the gun barrel; and a centering sleeve for centering the gun barrel disposed on an end face of said jacket pipe facing the muzzle brake.

10. The silencer according to claim 9, wherein said clamping device is a collet chuck.

11. The silencer according to claim 9, wherein said clamping device is formed with at least one seal, disposed on an inner circumference surrounding the gun barrel, for absorbing forces of a gas pressure produced when the shot is fired.

* * * * *